United States Patent [19]

Molovinsky

[11] 4,244,566

[45] Jan. 13, 1981

[54] LEVITATION DEVICE

[76] Inventor: Gale Molovinsky, 10502 Great Arbor Dr., Potomac, Md. 20854

[21] Appl. No.: 46,485

[22] Filed: Jun. 7, 1979

[51] Int. Cl.[3] ..... A63J 5/12

[52] U.S. Cl. ..... 272/9; 190/18 A

[58] Field of Search ..... 272/8 R, 8 D, 8 N, 9, 272/21, 24, 25; 206/577, 579, 223; 211/181, 182; 190/18 R, 18 A, 34, 1, 2, 42

[56] References Cited

U.S. PATENT DOCUMENTS

| | | | |
|---|---|---|---|
| 838,979 | 12/1906 | Goldin | 272/9 |
| 2,581,417 | 1/1952 | Jones | 190/18 A X |
| 3,522,955 | 8/1970 | Warner, Jr. | 190/18 A X |
| 4,087,102 | 5/1978 | Sprague | 190/18 A X |

FOREIGN PATENT DOCUMENTS

| | | | |
|---|---|---|---|
| 294307 | 7/1928 | United Kingdom | 190/1 |

OTHER PUBLICATIONS

Encyclopedia of Suspensions and Levitations: edited by Bruce Armstrong, 1976, Micky Hades International, Calgary, Alberta, Canada, pp. 75, 78, 95, 115 and 214.

*Primary Examiner*—Richard C. Pinkham
*Assistant Examiner*—Arnold W. Kramer

[57] ABSTRACT

This invention relates to theatrical illusion apparatus in general, and more specifically to an apparatus for performing a levitation illusion. The apparatus includes an improved body support frame which enhances the illusion that the suspended object or person has no external supporting means, when employed in conjunction with a rigid hoop which is passed around and over the suspended body. The support frame is supported through the aperture in a hinged lid of a trunk. The trunk has rollers for mobility when packed, and the trunk lid serves as the upper surface of a stage. A motor drive provides power to raise or lower the upper portion of the support frame with respect to the trunk stage.

7 Claims, 4 Drawing Figures

FIG. 1
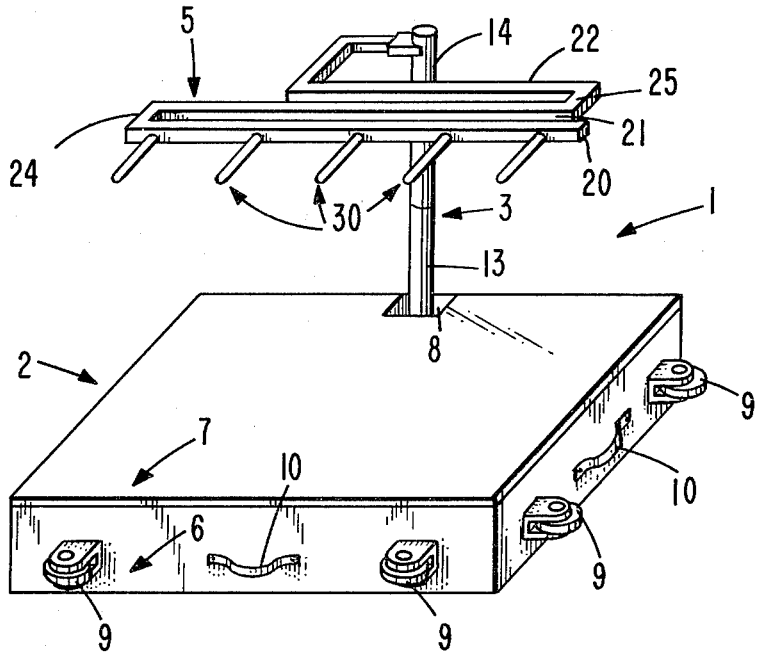
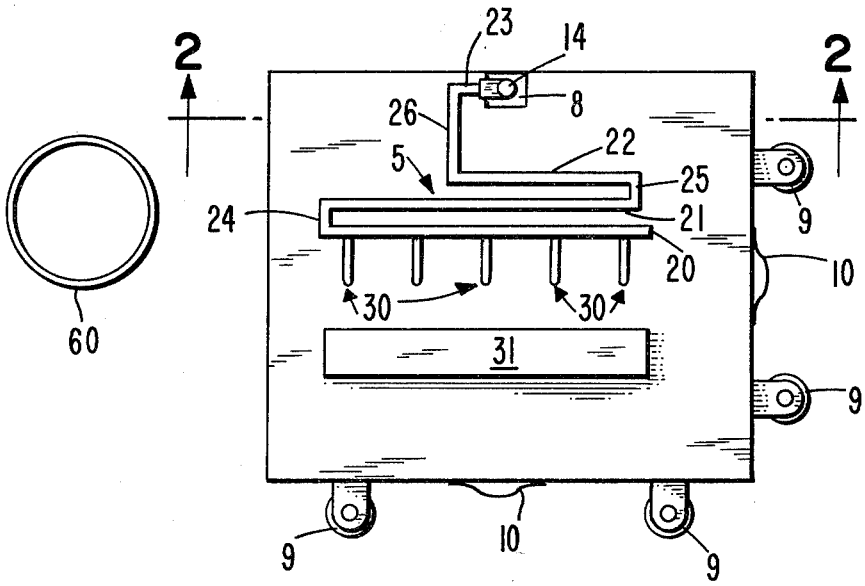
FIG. 3

FIG. 2
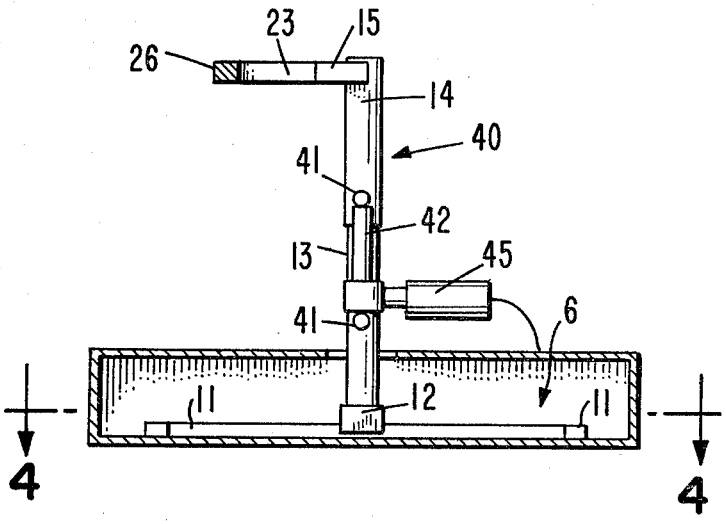
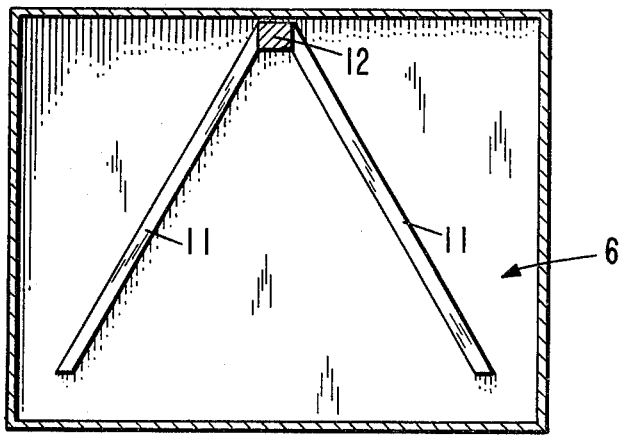
FIG. 4

LEVITATION DEVICE

BACKGROUND OF THE INVENTION

The arts of illusion and magic have been practiced through the centuries, and one of the most popular and astonishing feats has been the levitation of a person or physical object with no visible means of support or control by an outside force other than the audiences imagined power of the illusionist.

In reality the illusion of levitation has been accomplished in the past by various mechanisms such as those disclosed by H. Thurston et. al. U.S. Pat. No. 1,613,254, H. Goldin U.S. Pat. No. 838,979 and the examples found in "Encyclopedia of Suspensions and Levitations": edited by Bruce Armstrong (1976) Micky Hades International Calgary, Alberta, Canada (15BN-09-19230-49-0) particularly pages 75, 78, 93, 95, 115, and 214.

The prior art is characterized by the fact that they are cumbersome to work with, are either permanently installed or required temporary structural modification of a theater or similar environment, do not lend themselves to a totally believable illusory effect, and can not be readily installed, operated and transported to and from a performance site, by the illusionist alone, due to their enormous size and weight.

There has been a long felt need among practising illusionists and magicians for a lightweight, portable, self-contained levitation apparatus which is simple to operate, quiet, does not require a permanent stage and which lends itself to an enhanced visual illusion when used in conjunction with a rigid hoop.

SUMMARY OF THE INVENTION

An object of the present invention is the provision of a compact quiet, lightweight, portable, self-contained levitation apparatus and stage.

Another object is to provide a combined levitation apparatus and stage which is easy to transport and install at the performance site.

A further object of the invention is the provision of a levitation apparatus which can be easily and quietly operated by the illusionist alone.

Still another object is to provide an improved support for the person or object to be levitated which is designed to allow multiple passages of a rigid hoop element encircling the apparently suspended object or person to demonstrate that there are no external or hidden support means.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of the combined levitation apparatus and stage of the instant invention.

FIG. 2 is a sectional view of the instant invention taken through lines 2—2 of FIG. 3 and showing the levitation apparatus, controls and motor mounting.

FIG. 3 is a top view of the combined levitation apparatus and stage showing the design of the improved body support member in elevation.

FIG. 4 is a sectional view of the stage taken through lines 4—4 of FIG. 2.

DESCRIPTION OF THE PREFERRED EMBODIMENTS

As can be seen by reference to FIG. 1, the combined levitation apparatus and stage designated generally as 1 comprises a platform or stage 2 an upright support member 3 and a horizontal support member 5. As can be seen in FIG. 2 the upright support member 3 comprises a lower tubular member 13 and an upper tubular member 14 coaxially aligned and mounted for reciprocal movement on said lower tubular member. The stage 2 comprises a trunk 6 having a hinged lid 7 with an aperture 8 formed therein. The trunk 6 also has a plurality of swivel casters 9 and handles 10 mounted around its periphery.

AS can be seen in FIG. 4 the trunk 6 has a V-shaped support member 11 secured to its inner bottom wall by any suitable means. At the juncture of the V-shaped support member 11 is an upright support member securing means 12, which has inside dimensions slightly larger than the outside dimensions of the lower tubular member 13. The elements 12 and 13 are proportioned so that element 13 will fit securely inside element 12 in the assembled position. The upright support member securing means 12 is positioned directly beneath the aperture 8 in the trunk lid 7 when the lid is in the closed position. The trunk lid 7 also serves as an elevated stage platform for the illusionist.

As can be seen by reference to FIG. 2, the elevation mechanism 40 comprises a cylinder 42 operatively connected to the upper and lower vertical support member 14, 13 by suitable connections 41. The cylinder 42 is reciprocated by a mechanical screw thread device which is operated by an electric motor 45. The elevation mechanism 40 may be a mechanical actuator such as the "Mini-Pac" ® manufactured by Duff-Norton Company of Charlotte, North Carolina 28232, which is a small, compact, lightweight, quiet electric motor which runs off 115 V.A.C. current. It should be noted that the mounting shown in FIG. 3 is for illustration purposes only, and in practise the elevation mechanism 40 would be mounted on the back of the vertical support member, away from the view of the audience. It should also be noted that the tubular supports 13, 14 may have any geometical cross-sectional configuration as long as they are dimensioned for relative reciprocating movement.

At the top of the upper tubular member 14 is secured a short tubular support member 15 which projects at angle of from 0° to 10° from the horizontal plane through the upper tubular member 14. In the preferred embodiment shown in FIGS. 1–4 this angle is 5°. The purpose of this upward tilt of the short tubular support member is to compensate for the torque forces exerted on the tubular member by the cantilevered object which is utimately supported.

Referring now to FIG. 3 it can be seen that the horizontal support member comprises four generally parallel sections 20, 21, 22, 23 of diminshing length joined at alternating ends by three generally parallel intermediate connecting sections 24, 25, 26. The first and second connecting sections 24 and 25 are approximately the same length, while the third connecting section 26 is greater in length than the combined length of the other two.

Protruding from the longest parallel sections 20, at an angle of 0° to 10° from the horizontal, are a plurality of rod members 30. A platform 31 is intended to rest on the rod members 30 to provide a supporting surface for a person or object that will be apparently levitated. The purpose of the angular disposition of the rod members 30 is identical to that for the short tubular support member 15.

The horizontal support surface 5 is cantilevered from and detachably connected to the upright support member 3 by the sliding engagement of parallel section 23 with the short tubular support member 15.

Another feature of this device which should be mentioned is that all of the structural elements which comprise the levitation apparatus 1 can be stored easily within the trunk 6 for transportation to and from a performance site.

Once the levitation apparatus has been assembled the operation is as follows: A person or object is apparently supported by one or more structural objects such as chairs etc. (not shown) which are located adjacent to the stage. The illusionist stands at the position to obscure the upright support member from the audience's view. In reality the person or object is being supported by the platform 31 which is resting on the rod members 30 of the horizontal support member 5. By actuating the elevation mechanism 40 through a switch element (not shown) the motor 45 causes the upper tubular member 14 to progressively move upward on the lower tubular member 13 to provide the illusion that the person or object is rising with no apparent support and seemingly upon the command of the illusionist. When the subject has reached an appropriate height, above any observable supporting structure, the elevation mechanism is deactivated and the "repeating" S-shaped configuration of the horizontal support member 5 comes into play. A rigid hoop member 60 having a diameter greater than the combined horizontal lengths of elements 30 and 24 is then employed to further heighten the illusion of no external supports for the levitated body. The rigid hoop may be passed over, under and completely encircling the levitated body from either the right hand or left hand direction depending upon the whim of the illusionist and his manipulation of the rigid hoop.

The "repeating" S-shaped configuration of the horizontal support member 5 substantially increases the hoop manipulation available to the illusionist over prior art devices in that a complete encirclement of the suspended subject may be initiated from either direction as well as passage of the hoop completely under the suspended body from either direction, which was not possible before.

The spacing between the parallel sections 20, 21, 22 allows the illusionist to place his arm between adjacent sections 20, 21 or 21, 22 to accomplish this feat, which no prior art device has been able to accomplish.

Obviously many modifications and variations of the present invention are possible in light of the above disclosure. It is therefore to be understood that, within the scope of the appended claims, the invention may be practised otherwise than as specifically described.

I claim:

1. An improved levitation illusion apparatus for use in conjunction with a rigid hoop comprising;

a rectangular stage having an aperture therein, an upright support member extending through said aperture and operatively connected to said stage, a horizontal support member extending from said upstanding support member at an angle of from 0° to 10° from the horizontal; wherein, said horizontal support member comprises: four parallel support member sections whose length increases as their horizontal distance from the upright support member increases, three parallel intermediate support member sections which connect the four parallel support member sections together; and the rectangular stage comprises;

a trunk body having a hinged apertured lid, a plurality of rollers mounted on the periphery of the trunk body, a support fixture rigidly attached to a wall of the trunk body, whereby said support fixture removably secures said upright support member in the vertical position through the apertured lid acting as the top surface of the stage.

2. An improved levitation illusion apparatus as in claim 1, wherein, said upright support member includes:

a lower section removably connected to the stage, an upper section mounted for reciprocating movement relative to said lower section, and a motor operatively connected to said upper and lower sections to provide the relative movement between said sections.

3. An improved levitation illusion apparatus as in claim 2; wherein the upper section also includes a support element which protrudes from the upper section at an angle of from 0° to 10° from the horizontal and slidingly engages the horizontal support member.

4. An improved levitation illusion apparatus as in claim 3; wherein, the longest of the four parallel support member sections has a plurality of rod elements protruding therefrom at an angle of 0° to 10° from the horizontal.

5. An improved levitation illusion apparatus as in claim 4; wherein, the three parallel intermediate support member sections connect the four parallel support member sections at alternate ends to form a repeating S-shaped configuration for the horizontal. support member.

6. An improved levitation illusion apparatus as in claim 5; wherein,

The length of the intermediate support member section closest to the upright support member is at least twice the combined length of the remaining intermediate support member sections.

7. An improved levitation illusion apparatus as in claim 2, wherein, the upright support member, the horizontal support member, and the motor may be detached from one another and selectively disassembled to be stored within said trunk body.

* * * * *